US009371204B2

(12) United States Patent
Inoue et al.

(10) Patent No.: US 9,371,204 B2
(45) Date of Patent: Jun. 21, 2016

(54) SHEET FEEDING APPARATUS AND IMAGE FORMING APPARATUS

(71) Applicant: CANON KABUSHIKI KAISHA, Tokyo (JP)

(72) Inventors: Tomonari Inoue, Suntou-gun (JP); Yasuhito Fujinuma, Susono (JP); Motohiro Furusawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 14/146,088

(22) Filed: Jan. 2, 2014

(65) Prior Publication Data

US 2014/0197591 A1 Jul. 17, 2014

(30) Foreign Application Priority Data

Jan. 11, 2013 (JP) ..... 2013-003900

(51) Int. Cl.

| | |
|---|---|
| ***B65H 3/52*** | (2006.01) |
| ***B65H 1/14*** | (2006.01) |
| ***B65H 3/06*** | (2006.01) |
| ***B65H 3/56*** | (2006.01) |
| ***B65H 3/68*** | (2006.01) |
| ***B65H 7/04*** | (2006.01) |

(52) U.S. Cl.

CPC ..... *B65H 3/5223* (2013.01); *B65H 1/14* (2013.01); *B65H 3/0684* (2013.01); *B65H 3/56* (2013.01); *B65H 3/68* (2013.01); *B65H 7/04* (2013.01); *B65H 2402/46* (2013.01); *B65H 2402/543* (2013.01); *B65H 2405/1134* (2013.01); *B65H 2405/1136* (2013.01); *B65H 2511/515* (2013.01); *B65H 2513/40* (2013.01)

(58) Field of Classification Search

CPC ..... B65H 3/52; B65H 3/5207; B65H 3/5215; B65H 3/5223; B65H 2405/113; B65H 2504/1134; B65H 2405/1136; B65H 3/68

USPC ..... 271/121, 124, 167

See application file for complete search history.

(56) References Cited

U.S. PATENT DOCUMENTS 5,377,970 A * 1/1995 Kikuchi ..... B65H 3/5223 271/117

5,622,364 A 4/1997 Dutton et al.

(Continued)

FOREIGN PATENT DOCUMENTS

AU 1621097 A 10/1997

AU 711844 B2 10/2013

(Continued)

*Primary Examiner* — Prasad Gokhale

(74) *Attorney, Agent, or Firm* — Fitzpatrick, Cella, Harper & Scinto

(57) ABSTRACT

The sheet feeding apparatus includes a sheet tray on which sheets are stacked, a feeding roller which contacts a top sheet on the sheet tray and feeds the sheet in a sheet feeding direction, and a pair of intermediate conveying rollers which receives the fed sheet and conveys the sheet in a sheet conveying direction. The sheet feeding apparatus further includes a fixed slope portion, a sheet separation member, and an opposite member. The fixed slope portion includes a separation slope which is inclined in downstream of the sheet feeding direction as it is closer to the pair of intermediate conveying rollers, so as to abut against the sheet fed by the feeding roller and separate the sheet one by one. The sheet separation member and the opposite member have a separation nip portion which separates the sheet having passed through the separation slope one by one.

20 Claims, 14 Drawing Sheets

(56) References Cited

U.S. PATENT DOCUMENTS

| | | | | |
|---|---|---|---|---|
| 5,823,524 | A * | 10/1998 | Kawada | B65H 3/5223 271/121 |
| 7,055,818 | B2 | 6/2006 | Furusawa | |
| 7,976,014 | B2 * | 7/2011 | Kobayashi | B41J 3/543 271/119 |
| 8,439,358 | B2 | 5/2013 | Watanabe et al. | |
| 8,682,240 | B2 | 3/2014 | Fukita et al. | |
| 8,740,215 | B2 | 6/2014 | Watanabe et al. | |
| 9,073,714 | B2 * | 7/2015 | Kim | B65H 3/0607 |
| 2006/0180989 | A1 * | 8/2006 | Seike | B65H 3/5223 271/121 |
| 2008/0122162 | A1 * | 5/2008 | Bokelman | B65H 3/0684 271/124 |
| 2008/0309000 | A1 * | 12/2008 | Tu | B65H 3/0684 271/109 |
| 2009/0026693 | A1 * | 1/2009 | Lim | B65H 1/04 271/121 |
| 2011/0156340 | A1 * | 6/2011 | Otsuki | B65H 1/04 271/10.09 |
| 2012/0080836 | A1 * | 4/2012 | Morisaki | B65H 3/5223 271/121 |
| 2012/0080838 | A1 * | 4/2012 | Osada | B65H 5/062 271/228 |
| 2013/0142561 | A1 * | 6/2013 | Kim | B65H 3/0607 400/642 |

FOREIGN PATENT DOCUMENTS

| | | | |
|---|---|---|---|
| EP | 0798248 | A2 | 3/1997 |
| EP | 0798248 | A3 | 10/1997 |
| EP | 0798248 | B1 | 10/1997 |
| JP | 05162876 | A * | 6/1993 |
| JP | 10-72142 | A | 3/1998 |

* cited by examiner

SHEET FEEDING APPARATUS AND IMAGE FORMING APPARATUS

BACKGROUND OF THE INVENTION

1. Field of the Invention

The present invention relates to a sheet feeding apparatus provided in an image forming apparatus, such as a copying machine, a facsimile machine, a laser beam printer, or a multifunction peripheral, and an image forming apparatus including the same.

2. Description of the Related Art

In the past, an image forming apparatus, such as a printer or a copying machine, has included a sheet feeding apparatus which separates sheets stacked on a sheet cassette or a sheet tray one by one and fed the separated sheet to an image forming portion. In such a sheet feeding apparatus, various separating methods are employed in a separating portion for separating the sheets one by one. For example, there is known a so-called slope separation method that separates a sheet by buckling a sheet while abutting a front edge of a sheet fed by feeding rollers against a separation slope in a feeding direction (see U.S. Pat. No. 5,622,364).

Recently, in the offices or homes, there has been an increasing demand for using a low-price small-sized printer or copying machine to be installed on a desk in use. In order to achieve this demand, one countermeasure is to further reduce the size and cost of a sheet feeding apparatus provided in a printer or a copying machine.

In a case where the sheet feeding apparatus employing the slope separation method described in Patent Literature 1 is used as the countermeasure, it is also easy to reduce the size of the low-cost apparatus. However, there is a problem that it is difficult to achieve the compatibility between separation performance for a sheet having a low rigidity (weak stiffness) (sheet having a thin thickness) and conveyance performance for a sheet having a high rigidity (strong stiffness) (sheet having a thick thickness) is difficult.

The present invention is directed to provide a sheet feeding apparatus capable of exhibiting stable separation feeding performance in both of a sheet having a low rigidity and a sheet having a high rigidity in a slope separation method, and an image forming apparatus including the sheet feeding apparatus.

SUMMARY OF THE INVENTION

According to the present invention, a sheet feeding apparatus includes: a sheet stacking unit on which sheets are stacked; a feeding unit which contacts a top sheet of the sheets stacked on the sheet stacking unit, and feeds the sheet in a sheet feeding direction; a conveying unit which receives the sheet fed by the feeding unit and conveys the sheet in a sheet conveying direction intersecting with the sheet feeding direction; a first separating unit which is disposed between the feeding unit and the conveying unit, and includes a separation slope inclined to be located in downstream in the sheet feeding direction as going to upside, so as to abut against a front edge of the sheet fed by the feeding unit and separate the sheet one by one; and a second separating unit which is disposed between the first separating unit and the feeding unit, and includes a separation nip portion which separates the sheet having passed through the separation slope one by one.

According to the present invention, a sheet feeding apparatus includes: a sheet stacking unit on which sheets are stacked; a feeding unit which contacts a top sheet of the sheets stacked on the sheet stacking unit, and feeds the sheet in a sheet feeding direction; a conveying unit which receives the sheet fed by the feeding unit and conveys the sheet in a sheet conveying direction intersecting with the sheet feeding direction; a separation slope which is disposed between the feeding unit and the conveying unit and is inclined to be located in downstream in the sheet feeding direction as going to upside, so as to abut against a front edge of the sheet fed by the feeding unit and separate the sheet one by one; a friction member which is disposed on the separation slope in a center of a width direction perpendicular to the sheet feeding direction, the sheet slidably contacting the friction member; an opposite member which is disposed to face the friction member; and a biasing unit which biases one of the friction member and the opposite member against the other.

According to the present invention, it is possible to exhibit stable separation feeding performance in both of a thin sheet having a low rigidity and a sheet having a high rigidity in a slope separation method.

Further features of the present invention will become apparent from the following description of exemplary embodiments with reference to the attached drawings.

DESCRIPTION OF THE EMBODIMENTS

First Embodiment

Hereinafter, exemplary embodiments of the present invention will be described in detail with reference to the accompanying drawings. Also, the shapes and relative arrangements of components set forth in the embodiments may be appropriately changed according to configurations or various conditions of apparatuses to which the present invention is applied, and the scope of the present invention is not intended to be limited to the following embodiments.

First, an overall configuration of an image forming apparatus 100 equipped with a sheet feeding apparatus 1 according to a first embodiment of the present invention will be described with reference to FIG. 8. Also, FIG. 8 is a schematic diagram illustrating the image forming apparatus 100 according to the first embodiment.

Figure 8:
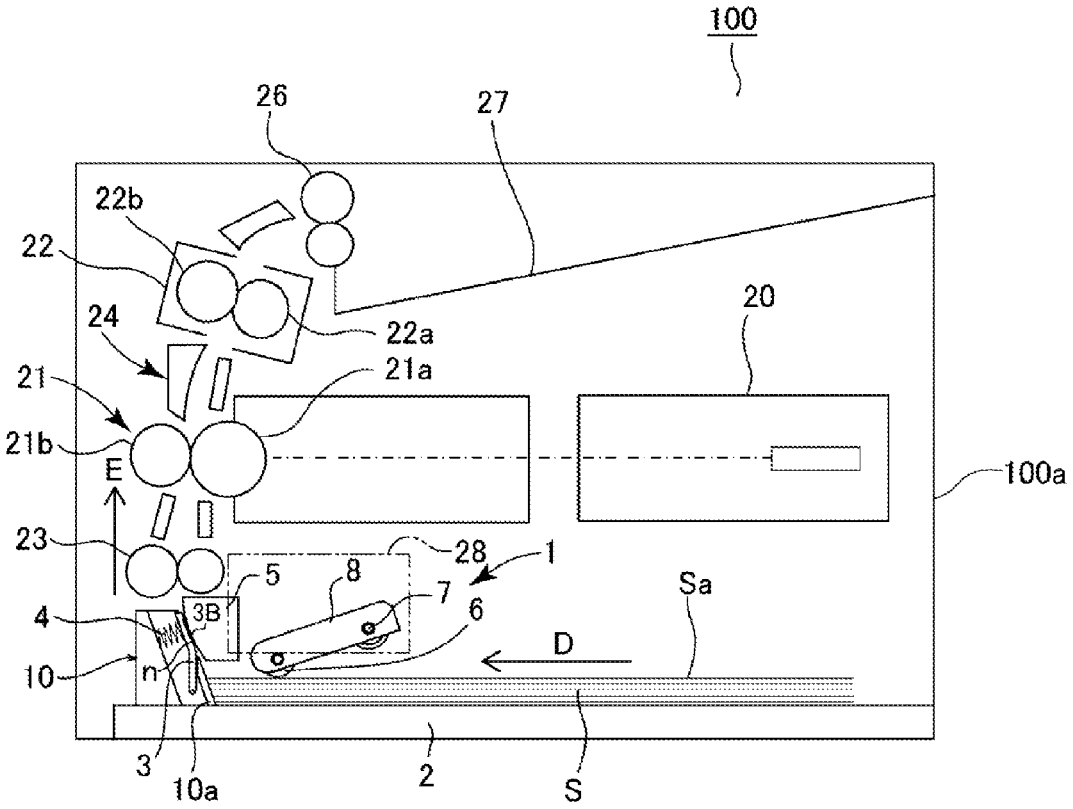
FIG. 8 is a schematic configuration diagram illustrating a configuration of an image forming apparatus according to a first embodiment.

As illustrated in FIG. 8, the image forming apparatus 100 includes an image forming apparatus body (hereinafter, referred to as an apparatus body) 100*a*, and a sheet feeding apparatus 1 is disposed in a lower portion of the apparatus body 100*a*. The sheet feeding apparatus 1 includes a sheet tray 2 in which sheets (sheet bundle) S are stacked. The sheet tray 2 as a sheet stacking unit is fixed to the apparatus body 100*a*.

The sheet feeding apparatus 1 includes a feeding roller 6 as a feeding unit which contacts a top sheet Sa of the sheets stacked on the sheet tray 2 and feeds the sheet in a sheet feeding direction (direction of an arrow D). Furthermore, the sheet feeding apparatus 1 includes a pair of intermediate conveying rollers 23 as a conveying unit which receives the sheet fed by the feeding roller 6 and feeds the sheet along a sheet conveying direction (direction of an arrow E) intersecting with the sheet feeding direction D. The sheet bundle S stacked on the sheet tray 2 is fed while being separated sheet by sheet by the feeding roller 6, a separation slope 10*a* of a fixed slope portion 10, and a sheet separation member 3, and is fed to a sheet conveyance path 24 within the apparatus body 100*a*.

The pair of intermediate conveying rollers 23 is disposed in the middle of the sheet conveyance path 24 within the apparatus body 100*a*, and the sheet S is conveyed toward an image forming portion 21 of downstream by the pair of intermediate conveying rollers 23. In an image formation by the image forming portion 21, a laser beam is irradiated on a photosensitive drum 21*a* as a previously-charged image bearing member from a laser exposure device 20 according to image information, and an electrostatic latent image is written on the photosensitive drum 21*a*. When the electrostatic latent image is formed on the photosensitive drum 21*a*, a toner is attached to the electrostatic latent image and developed by a development device (not illustrated), and the electrostatic latent image is visualized as a toner image.

In the image forming portion 21, a transfer roller 21*b* disposed to face the photosensitive drum 21*a* is pressed to configure a primary transfer portion. In the image forming portion 21, when the sheet S passes through a transfer nip portion between the photosensitive drum 21*a* and the transfer roller 21*b*, the toner image on the surface of the photosensitive drum 21*a* is transferred on the sheet S.

In downstream of the image forming portion 21 in the sheet conveyance path 24, a fixing device 22 is provided which includes a heating roller 22*a* and a pressure roller 22*b* disposed to face the heating roller 22*a* and pressed thereto. When the sheet S after the transfer of the toner image passes through a fixing nip portion between the heating roller 22*a* and the pressure roller 22*b*, the fixing device 22 fixes the toner image on the sheet S as an image. The image forming portion 21 as described above forms the image on the sheet S, which is fed by the sheet feeding apparatus 1, by the laser exposure device 20, the primary transfer portion configured by the photosensitive drum 21*a* and the transfer roller 21*b*, and the fixing device 22.

Then, the sheet S after the image fixation is conveyed more downstream, and the pair of discharge rollers 26 discharges the image plane downwards (facedown) to a discharge tray 27 formed on the upper surface of the apparatus body 100*a*.

Figure 1A:
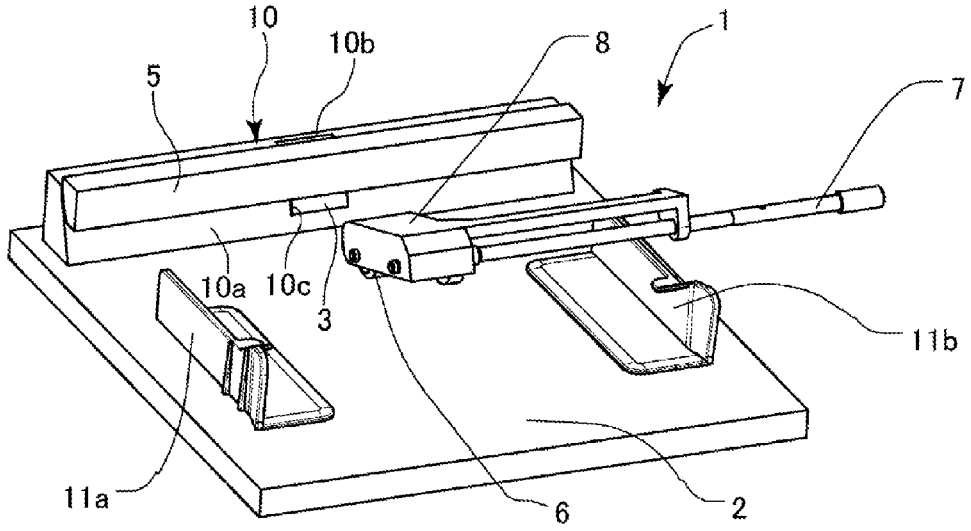
FIGS. 1A and 1B are a perspective view and a cross-sectional view of a sheet feeding apparatus according to a first embodiment of the present invention, respectively.
Figure 1B:
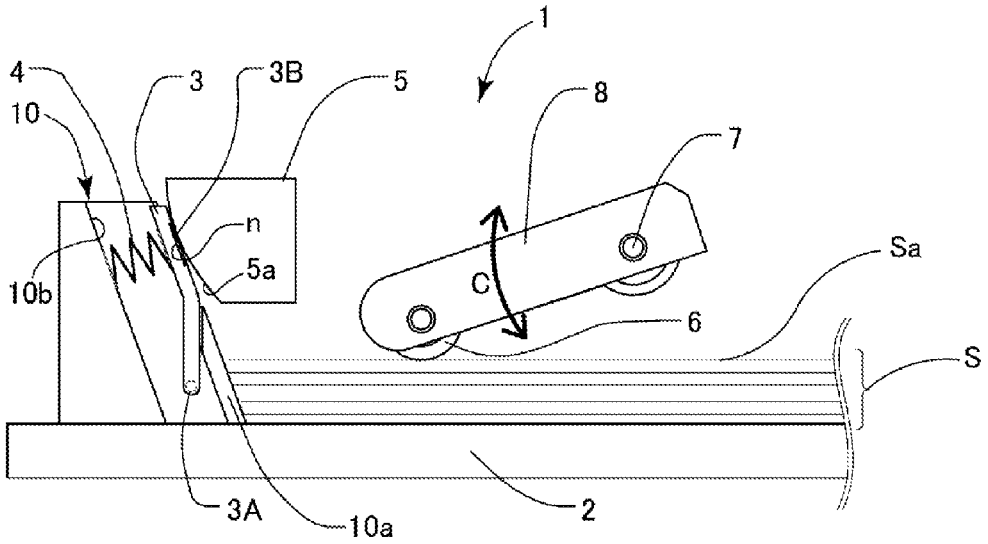

Next, the configuration of the sheet feeding apparatus 1 provided in the apparatus body 100*a* will be described in detail. Incidentally, FIG. 1A is a perspective view of the sheet feeding apparatus 1 according to the present embodiment, and FIG. 1B is a cross-sectional view of the sheet feeding apparatus 1.

In the sheet tray 2 in which the sheets S are stacked and set, width regulating portions 11*a* and 11*b* are disposed to be movable in a width direction. The width regulating portions 11*a* and 11*b* regulate a position of a sheet width direction (width direction, horizontal direction of FIG. 1A) perpendicular to the sheet feeding direction of the sheet (front-rear direction of FIG. 1A, direction of the arrow D of FIG. 8). Also, in the sheet tray 2, the fixed slope portion 10 is disposed which includes the separation slope 10*a* inclined so as to regulate a front edge of the sheet S in downstream of the sheet feeding direction. The separation slope 10*a* has a flat plate shape, and the inclination is set to be sloped to a direction away from the sheet S on the sheet tray 2 (downstream of the sheet feeding direction) as it goes to a top edge. Also, the separation slope 10*a* extends right and left in the sheet width direction perpendicular to the sheet feeding direction, such that it is set to be larger in the width direction than the width of the maximum size of the sheet to be used.

The feeding roller 6 is disposed above the downstream of the sheet feeding direction in the sheet tray 2. The feeding roller 6 is rotatably held to a pivot frame 8 that is pivotally supported in a vertical direction (direction of an arrow C of FIG. 1B), with a pivot shaft 7 as a pivot point.

One end of the pivot shaft 7 supports upstream of the sheet feeding direction of the pivot frame 8, and the other end of the pivot shaft 7 extending in a direction vertically separated from the pivot frame 8 is supported to a support frame 28 (see FIG. 8) of the apparatus body 100*a*. A drive motor (not illustrated) as a drive source which drives a constituent part corresponding to the sheet feeding apparatus 1, and a drive transmission mechanism (not illustrated) including a gear which transmits a driving force of the drive motor are supported to the support frame 28.

Since the driving force of the drive motor is transmitted through the drive transmission mechanism, the feeding roller 6 rotates clockwise in FIG. 1B. The feeding roller 6 abuts against the top surface of the sheet S stacked on the sheet tray 2 by rotating downward in a state of being held to the pivot frame 8, and feeds the sheet S by rotating clockwise in the abutting state. If an amount of sheets stacked on the sheet tray 2 is reduced, the feeding roller also moves downward so that the abutting state is maintained.

A feeding unit is provided with the feeding roller 6 which feeds the sheet S by rotating while abutting against the sheet S stacked on the sheet tray 2, and the pivot frame 8 which is pivotally provided to support the feeding roller 6. In the feeding unit, when an amount of stacked sheets S is reduced, the feeding roller 6 moves downward so that the abutting against the sheet S is maintained.

Next, the configuration of the portion which mainly separates the sheet in the sheet feeding apparatus 1 according to the present embodiment will be described with reference to FIG. 1B. FIG. 1B illustrates a state in which the sheet bundle S is set in the sheet tray 2.

As illustrated in FIG. 1B, a downstream end (front edge) of the sheet feeding direction of the sheet bundle S is regulated by the separation slope 10*a*. The separation slope 10*a* is formed to have an inclined shape such that it is located in the downstream of the sheet feeding direction as it goes to upside (upward) so as to abut against the front edge of the sheet S fed by the feeding roller 6 and separate sheets one by one. At a central portion of the separation slope 10*a* in a horizontal direction of FIG. 1A, a notch portion 10*c* cut in a rectangular shape is formed. A sheet separation member 3 is provided in the notch portion 10*c*.

The sheet separation member 3 is pivotally supported around the pivot point 3A as a supporting point, the pivot point 3A being provided downstream in the inside of the notch portion 10*c*, and a force is applied toward an opposite member 5 by a compression spring 4 as a biasing unit which is provided in a compressed state between a rear portion 10*b* of the inside and a rear surface of the sheet separation member 3. In this manner, a friction member 3B attached on the sheet separation member 3 is pressed against the opposite member 5 to constitute a separation nip portion n. In the present embodiment, the friction member 3B is biased against the opposite member 5 by the compression spring, but this relationship may be reversed. The opposite member 5 may be configured to be biased against the friction member 3B by the compression spring (not illustrated). The opposite member 5 has a curved surface 5*a* which guides the fed sheet S by sliding contact. Paths, through which the sheet can pass, are provided between the separation slope 10*a* and the opposite member 5 and between the sheet separation member 3 and the opposite member 5.

Therefore, the sheet separation member 3 is biased by the compression spring 4 which is movable to a protruding position (position of FIG. 1B) protruding from the separation slope 10*a* and pressed against the opposite member 5, and a retracted position (position retracted from the position of FIG. 1B) which is retracted from the separation slope 10*a* to the inside of the notch portion 10*c*.

Incidentally, the fixed slope portion 10 is disposed between the feeding roller 6 and the pair of intermediate conveying rollers 23 and configures a first separating unit having a separation slope 10*a*. Also, the sheet separation member 3, the opposite member 5, and the compression spring 4 are disposed between the fixed slope portion 10 and the pair of intermediate conveying rollers 23 and configure a second separating unit having the separation nip portion n which separates the sheet S having passed through the separation slope 10*a* one by one.

In the present embodiment, the sheet separation member 3 is biased against the opposite member 5 by the compression spring 4, but this relationship is not limited thereto. The opposite member 5 may be configured to be biased against the sheet separation member 3 by the biasing unit instead of the compression spring 4. Alternatively, the sheet separation member 3 and the opposite member 5 may be configured to abut against each other by the biasing unit.

The opposite member 5 is located on an opposite side of the sheet separation member 3 which is fixedly held to the support frame 28 (FIG. 8) of the apparatus body 100*a* holding the pivot shaft 7. Since the sheet separation member 3 abuts against the opposite member 5, the position and posture of the sheet separation member 3 are maintained. The friction member 3B attached to a part of the sheet separation member 3 abutting against the opposite member 5 is made of a rubber sheet or the like which is usually used in a feeding separation portion of the image forming apparatus.

Subsequently, a principle of separating the sheet S by the slope and feeding the separated sheet S will be described with reference to FIGS. 2 and 3. Incidentally, FIG. 2 is a diagram illustrating a force generated between the feeding roller 6 and the separation slope 10*a* at the time of sheet feeding, and FIG. 3 is a graph illustrating a relationship between a conveyance resistance P [gf] and a feeding pressure N [gf] of the feeding roller 6.

Figure 2:
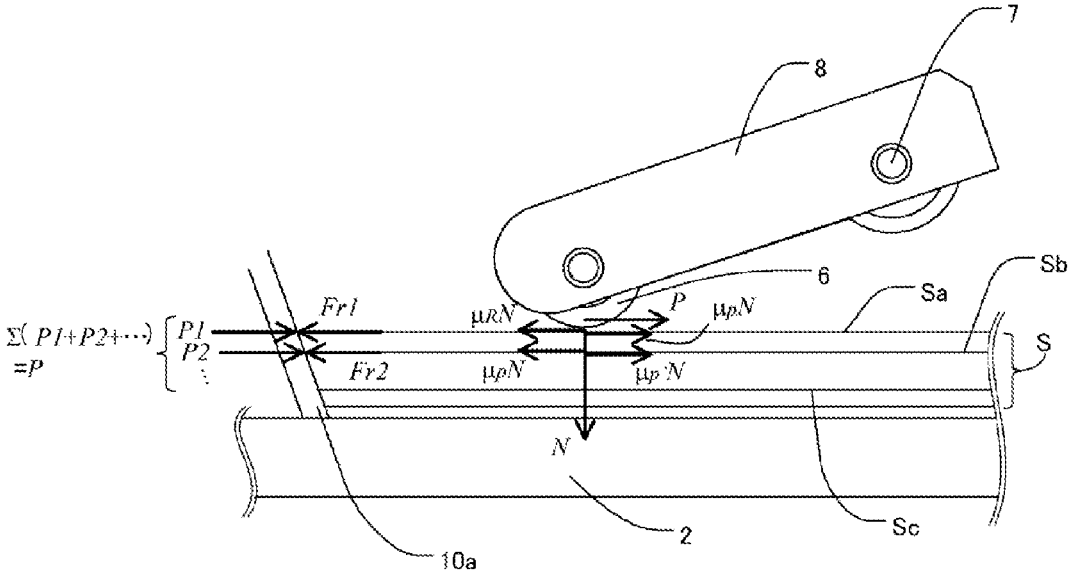
FIG. 2 is a diagram illustrating a force generated in a feeding roller 6 and a separation slope 10*a* at the time of feeding according to the first embodiment.
Figure 3:
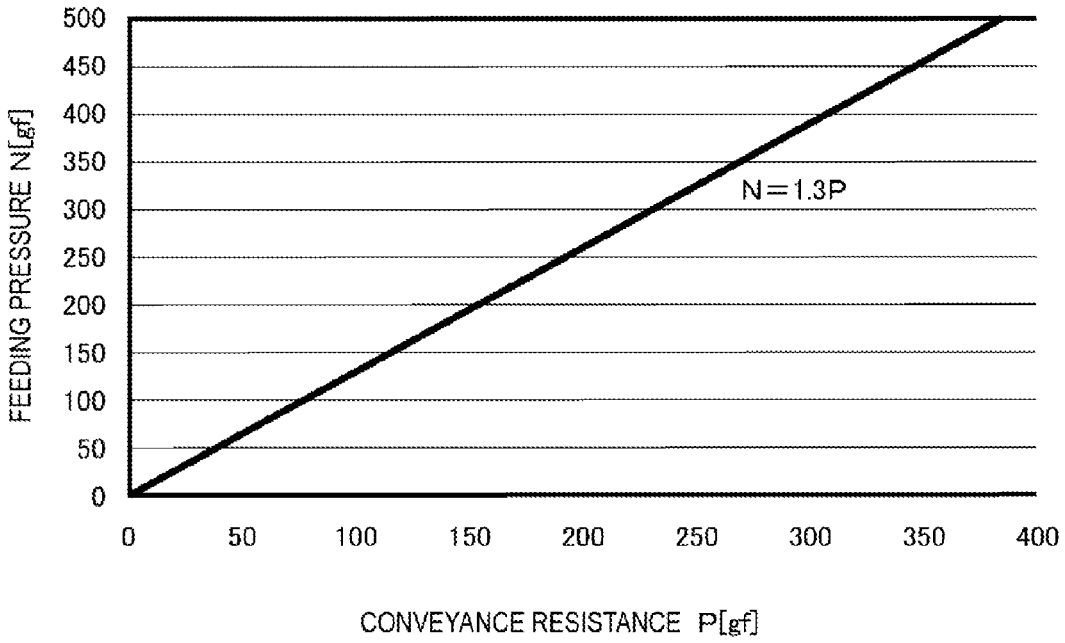
FIG. 3 is a graph illustrating a relationship between a conveyance resistance P and a feeding pressure N of the feeding roller 6 according to the first embodiment.

That is, as illustrated in FIG. 2, the feeding roller 6 generates the feeding pressure N to the sheet by transferring rotation in a state of abutting against the top sheet Sa of the sheet bundle S. When a friction coefficient between the feeding roller 6 and the sheet is μR, the top sheet Sa obtains a conveyance force Fr (=μR·N) generated by the feeding roller 6.

On the other hand, when a friction coefficient between the top sheet Sa and a second sheet Sb is μp, the top sheet Sa receives a resistance force Rr1 (=μp·N) by the second sheet Sb, and thus, a conveyance force Fr1 generated in the top sheet Sa is expressed as Equation (1) below.

$$Fr1=Fr-Rr1=(\mu R-\mu p)N \quad (1)$$

When the top sheet Sa is conveyed by the conveyance force Fr1 generated in the top sheet Sa, the front edge in the sheet feeding direction abuts against the separation slope 10*a*, and a conveyance resistance P1 generated in the top sheet is generated in a direction substantially horizontal to the sheet. Due to the resistance, a conveyance resistance P is generated in a direction substantially horizontal to the feeding roller 6.

When a plurality of sheets is taken out, the conveyance resistance P generated in the feeding roller 6 is the sum of conveyance resistances generated in the respective sheets. In the configuration of the feeding roller 6 according to the present embodiment, the feeding pressure N is changed according to the magnitude of the conveyance resistance P generated in the feeding roller 6.

Herein, the relationship between the conveyance resistance P and the feeding pressure N generated in the feeding roller 6 will be described below. FIG. 3 is a graph illustrating the conveyance resistance P and the feeding pressure N generated in the feeding roller 6 in the configuration of the feeding roller 6 used in the present embodiment, and a linear relationship is established between the conveyance resistance P and the feeding pressure N. Also, a slope of a straight line in FIG. 3 is changed according to a slope (angle) of the pivot frame 8 or a distance between the pivot shaft 7 and the feeding roller 6.

As illustrated in the graph of FIG. 3, in the configuration of the feeding roller 6 used in the present embodiment, the slope of the straight line in the graph is set to 1.3 (N=1.3P). When the feeding pressure N is increased by the conveyance resistance P generated in the feeding roller 6, the conveyance force Fr1 generated in the top sheet Sa is increased, and the conveyance resistance P1 generated in the top sheet Sa is also increased against the conveyance force Fr1.

Finally, when the conveyance force Fr1 generated in the top sheet Sa reaches a sheet buckling force Pz, the sheet is fed in a manner such that the front edge of the sheet buckles and gets on the separation slope 10*a*.

Subsequently, when a friction coefficient between the second sheet Sb and a third sheet Sc is μp', the conveyance force Fr2 generated in the second sheet Sb is given as illustrated in FIG. 2. That is, since the conveyance force Fr2 is a difference between a conveyance force FSa (=μp·N) the second sheet Sb receives from the top sheet Sa and a resistance force Rr2 (=μp'·N) by the third sheet Sc, the conveyance force Fr2 is expressed as Equation (2) below.

$$Fr2=FSa-Rr2=(\mu p-\mu p')N \quad (2)$$

In order not to cause a double feed, the conveyance force Fr2 generated in the second sheet Sb must not reach the sheet buckling force Pz. However, in the past, in the case of a sheet having a low rigidity (weak stiffness), such as a thin sheet, a sheet buckling force Pz is remarkably small, and the sheet easily gets on the slope portion with a small conveyance force even when the sheet is curled. Therefore, it is difficult to prevent a double feed.

Figure 4A:
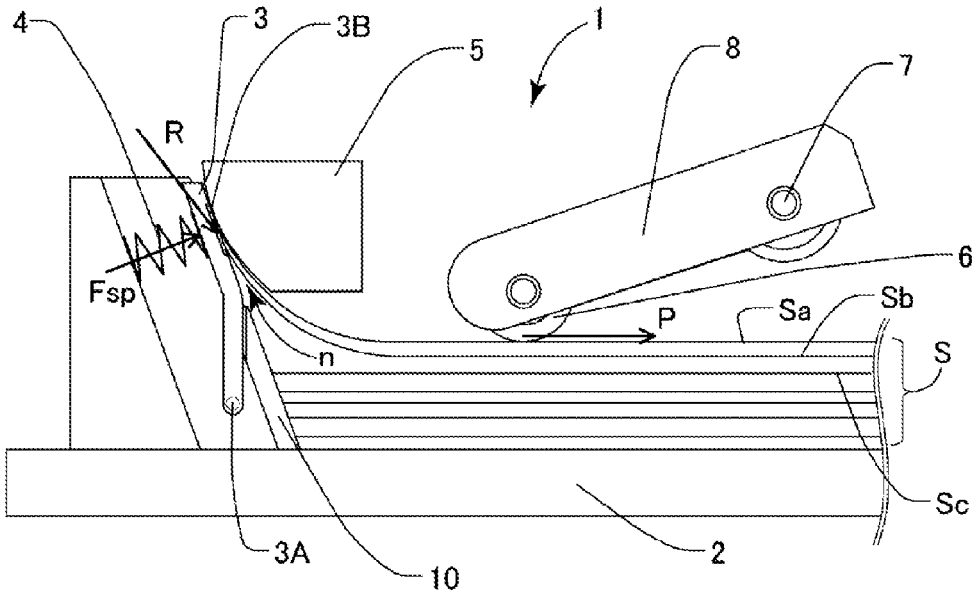
FIGS. 4A and 4B are diagrams illustrating a force acting on two sheets in a contact portion between a sheet separation member 3 and an opposite member 5 according to the first embodiment.
Figure 4B:
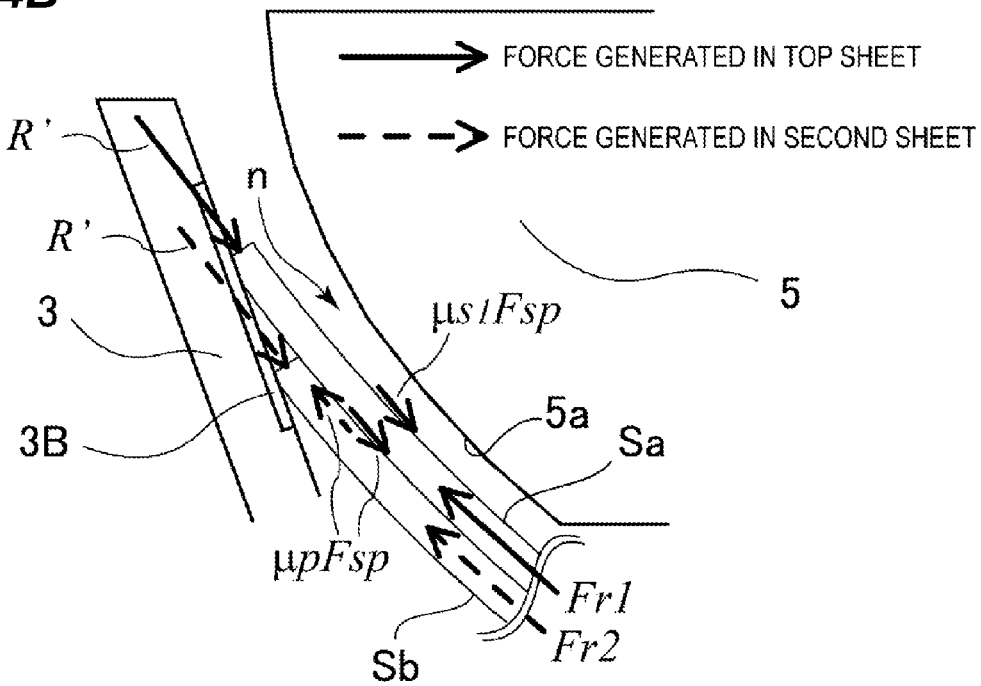

The feature of the present invention, that is, the principle of separating a plurality of sheets in the separation nip portion n between the sheet separation member 3 and the opposite member 5, will be described below with reference to FIGS. 4A and 4B. FIG. 4B is an enlarged view of the separation nip portion n between the sheet separation member 3 and the opposite member 5 in the cross-sectional view illustrated in FIG. 4A. For easy illustration of the force acting on each of the sheets, the sheet separation member 3 and the opposite member 5 are drawn away.

For example, when two sheets are conveyed across the separation slope 10*a* in an overlapped state, the two sheets enter the separation nip portion n between the sheet separation member 3 and the opposite member 5, and a resistance force R is generated with respect to the two sheets. That is, the resistance force R acting on the sheet is the sum of a resistance force R1 acting on the top sheet Sa and a resistance force R2 acting on the second sheet Sb (R=R1+R2).

Also, the resistance force R acting on the sheet gives a force against the sheet feeding direction of the feeding roller 6, and the conveyance resistance P generated in the feeding roller 6 at that time has the same value as the resistance force R acting on the sheet (P=R).

In each of the sheets, since the front edge in the sheet feeding direction abuts against the friction member 3B attached to the sheet separation member 3, a resistance force R' the sheet receives from the friction member 3B is generated. The sheet is conveyed while receiving the resistance force R' received from the friction member 3B in the front edge in the feeding direction, and the top sheet Sa is conveyed separately from the second sheet Sb.

Herein, it is assumed that a friction coefficient between the opposite member 5 and the sheet is μs1, and an acting force of the compression spring 4 is Fsp. In this case, when two sheets enter the separation nip portion n, the resistance force R1 acting on the top sheet Sa and the resistance force R2 acting on the second sheet Sb can be expressed as Equations (3) and (4) below.

$$R1=R'+(\mu s1+\mu p)Fsp \quad (3)$$

$$R2=R'-\mu p\cdot Fsp \quad (4)$$

In order to separately convey the two sheets, the conveyance force Fr1 generated in the top sheet Sa needs to exceed the value of the resistance force R1 acting on the top sheet Sa, and the conveyance force Fr2 generated in the second sheet Sb needs to be lower than the value of the resistance force R2 acting on the second sheet Sb. The above condition is expressed as Inequality below.

$$\text{(Non-feed prevention condition)}\ Fr1=(\mu R-\mu p)N>R'+(\mu s1+\mu p)Fsp$$

$$\text{(Double-feed prevention condition)}\ Fr2=(\mu p-\mu p')N<R'-\mu p\cdot Fsp$$

Herein, in a condition that the friction coefficient of the friction member 3B is 0.8, the acting force Fsp of the compression spring 4 is 150 gf (≈1.47 N (Newton)), and the angle of the sheet separation member 3 with respect to the horizontal direction is 70°, the sheet is fed in a state in which the front edge in the feeding direction of various sheets abuts against the friction member 3B. In this case, the measurement result of the resistance force R' the sheet receives from the friction member 3B is illustrated in FIG. 5.

Figure 5:
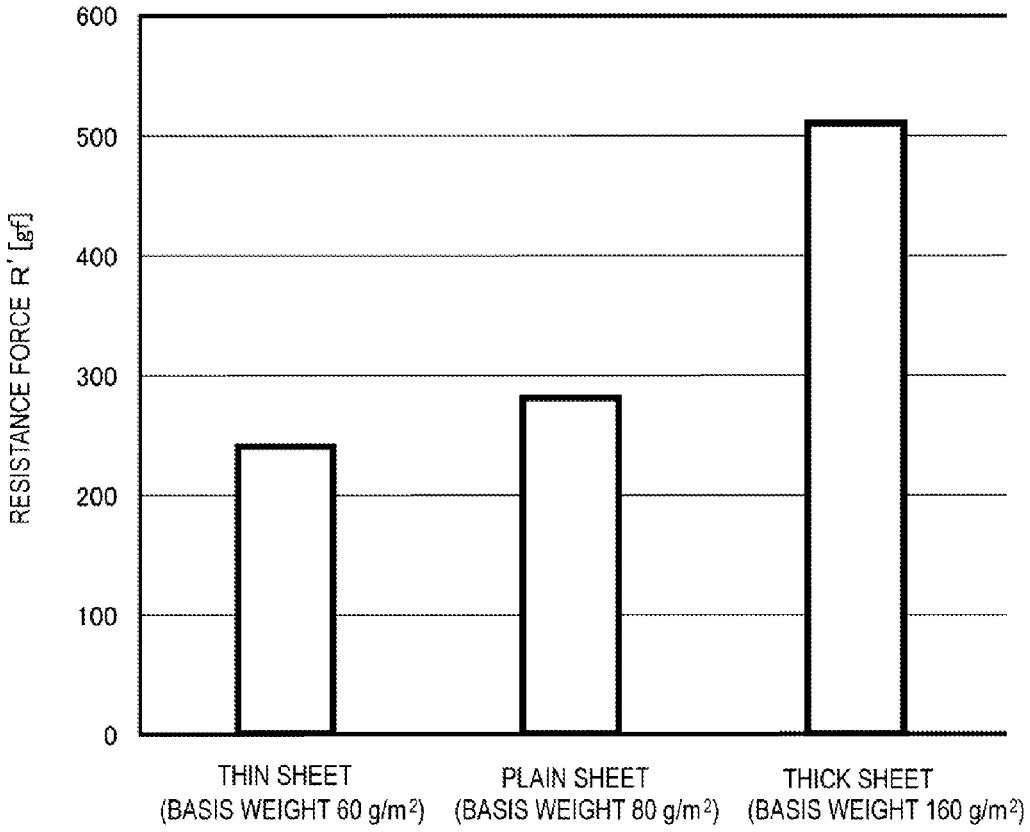
FIG. 5 is a graph illustrating a measured value of a resistance force when various sheets abut against a friction member 3B.

In FIG. 5, resistance forces of various sheets illustrated by bar graphs represent resistance values in the sheet feeding direction at the moment when the front edge of the sheet is conveyed over the friction member 3B, and the resistance forces are changed by the magnitude of the rigidity (strength of stiffness) of the sheet.

The front edge of the sheet is conveyed over the friction member 3B at the moment when a resistance force of a thin sheet (basis weight 60 g/m2) becomes 240 gf (≈2.35 N), a resistance force of a plain sheet (basis weight 80 g/m2) becomes 280 gf (≈2.74 N), and a resistance force of a thick sheet (basis weight 160 g/m2) becomes 510 gf (≈5.00 N).

Whether the thin sheet can be separately conveyed is verified using the above calculation formula. The resistance force R' the sheet receives from the friction member 3B is verified on the assumption that the resistance force of the thin sheet in FIG. 5 is 240 gf and the friction coefficient μs1 between the opposite member 5 and the sheet is 0.1. Furthermore, it is assumed that the acting force Fsp of the compression spring 4 is 150 gf, the friction coefficient μR between the feeding roller 6 and the sheet is 1.5, the friction coefficient μp between the top sheet Sa and the second sheet Sb is 0.6, and the friction coefficient μp' between the second sheet Sb and the third sheet Sc is 0.4.

Also, the values of the above friction coefficients are set based on a value of a friction coefficient of a rubber roller usually used as the feeding roller of the image forming apparatus, or a value of a friction coefficient of a sheet frequently used, such as a so-called plain sheet.

In this case, the resistance force R1 acting on the top sheet Sa is 345 gf (≈3.38 N (Newton)), and the resistance force R2 acting on the second sheet Sb is 150 gf (≈1.47 N). Since the resistance force R acting on the sheet is the sum of these resistance forces, the resistance force R acting on the sheet is 495 gf (≈4.85 N), and the conveyance resistance P generated in the feeding roller 6 is also 495 gf (≈4.85 N).

Since the slope of the straight line in FIG. 3 is 1.3, the feeding pressure N generated at this time is 643.5 gf (≈6.31 N (Newton)). The conveyance force Fr1 generated in the top sheet Sa and the conveyance force Fr2 generated in the second sheet Sb are 579.2 gf (≈5.67 N) and 128.7 gf (≈1.26 N), respectively.

Therefore, the conveyance force Fr1=579.2 gf generated in the top sheet Sa exceeds the resistance force R1=345 gf acting on the top sheet Sa. Also, since the conveyance force Fr2 (=128.7 gf) generated in the second sheet Sb is lower than the resistance force R2 (=150 gf) acting on the second sheet Sb, the sheet can be separately conveyed by the separation nip portion n.

Figure 6A:
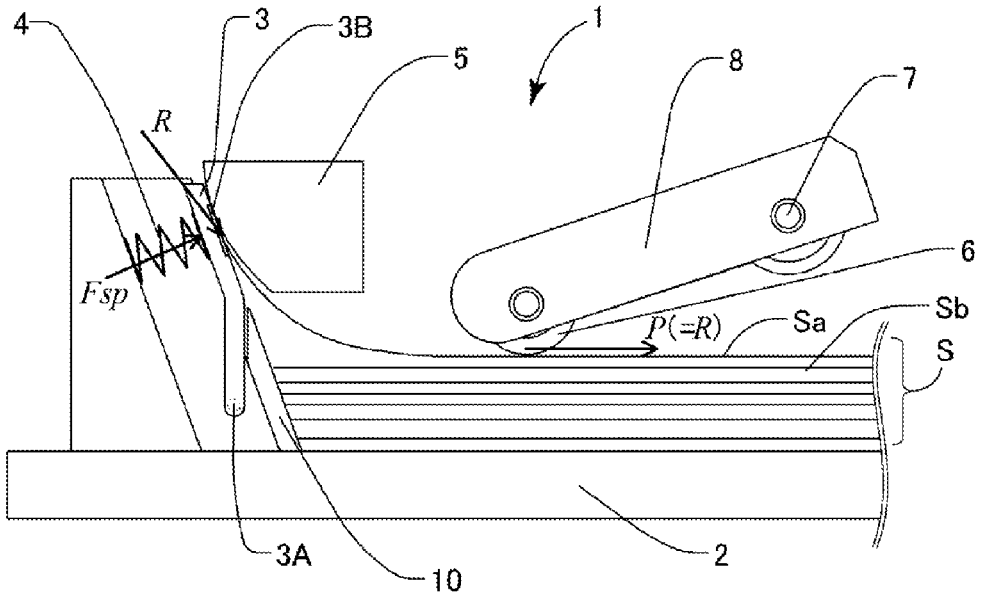
FIGS. 6A and 6B are diagrams illustrating a force acting on one sheet in the contact portion between the sheet separation member 3 and the opposite member 5.
Figure 6B:
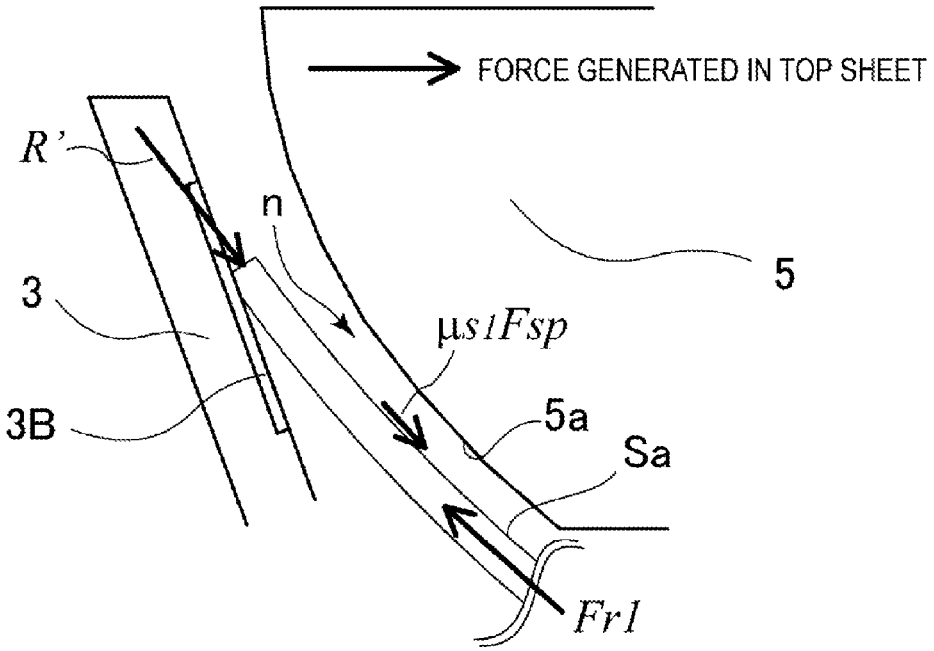

Subsequently, a case where one sheet enters the separation nip portion n will be described with reference to FIGS. 6A and 6B. The resistance force R1 acting on the top sheet Sa is expressed as Equation (5) below.

$$R1=R'+\mu s1\cdot Fsp \quad (5)$$

Herein, since the resistance force R acting on the sheet is only the resistance force R1 acting on the top sheet Sa, the resistance force R have the same value as the resistance force R1 (R=R1). In order to convey the sheet without jamming (conveyance failure) in the separation nip portion n, the conveyance force Fr1 generated in the top sheet Sa needs to exceed the value of the resistance force R acting on the sheet. The above condition is expressed as Inequality below.

$$\text{(Non-feed prevention condition)}Fr1=(\mu R-\mu p)N>R'-\mu s1\cdot Fsp$$

Herein, in the same manner as the above-described condition, it is assumed that the resistance force R' the sheet receives from the friction member 3B is 240 gf (≈2.35 N (Newton)), the friction coefficient μs1 between the opposite member 5 and the sheet is 0.1, and the acting force Fsp of the compression spring 4 is 150 gf (≈1.47 N). Also, on the assumption that the friction coefficient μR between the feeding roller 6 and the sheet is 1.5 and the friction coefficient μp between the top sheet Sa and the second sheet Sb is 0.6, a case where one thin sheet enters the separation nip portion n will be considered.

In this case, the resistance force R acting on the sheet is 255 gf (≈2.50 N), and the conveyance resistance P generated in the feeding roller 6 is also 255 gf.

Since the slope of the straight line in FIG. 3 is 1.3, the feeding pressure N generated at this time is 331.5 gf (≈3.25 N), and the conveyance force Fr1 generated in the top sheet Sa is 298.4 gf (≈2.92 N). In this case, since the conveyance force Fr1=298.4 generated in the top sheet Sa exceeds the resistance force R1=255 gf (≈2.50 N) acting on the top sheet Sa, the sheet can be conveyed without jamming in the separation nip portion n.

Also, whether the thick sheet also can be conveyed without jamming in the separation nip portion n is verified.

It is assumed that the resistance force R' the sheet receives from the friction member 3B is 510 gf (≈5.00 N) in the thick sheet of FIG. 5, the friction coefficient μs1 between the opposite member 5 and the sheet is 0.1, and the acting force Fsp of the compression spring 4 is 150 gf (≈1.47 N). Also, it is assumed that the friction coefficient μR between the feeding roller 6 and the sheet is 1.5 and the friction coefficient μp between the top sheet Sa and the second sheet Sb is 0.6. In this case, the resistance force R acting on the sheet is 525 gf (≈5.14 N), and the conveyance resistance P generated in the feeding roller 6 is also 525 gf.

Since the slope of the straight line in FIG. 3 is 1.3, the feeding pressure N generated at this time is 682.5 gf (≈6.69 N), and the conveyance force Fr1 generated in the top sheet Sa is 614.3 gf (≈6.02 N). In this case, since the conveyance force Fr1=614.3 gf generated in the top sheet Sa exceeds the resistance force R1=525 gf acting on the top sheet Sa, the sheet can be conveyed without jamming in the separation nip portion n.

Since the present embodiment is configured such that the feeding pressure N is changed according to the magnitude of the conveyance resistance P generated in the feeding roller 6, it is possible to change the feeding pressure N according to the magnitude of the sheet rigidity and to convey a wide variety of sheets.

In the sheet feeding apparatus 1 according to the present embodiment, the feeding roller 6 is configured to change the feeding pressure N according to the magnitude of the sheet conveyance resistance. Therefore, it is also possible to convey a sheet having a high rigidity, such as a thick sheet. Also, in a case where a plurality of sheets having a low rigidity, such as thin sheets, is simultaneously buckled and conveyed over the separation slope 10*a*, the sheet can be loosened in the separation nip portion n between the sheet separation member 3 and the opposite member 5. Therefore, it is possible to exhibit stable separation performance with respect to a wide variety of sheets.

According to the present embodiment described above, due to the separation member biased by the biasing unit and the opposite member disposed to contact the opposite position of the separation member, it is possible to obtain the effect of loosening the sheet in the separation nip portion between the separation member and the opposite member. Therefore, it is possible to obtain stable separation performance with respect to a wide variety of sheets, while achieving space saving and low-cost configuration.

That is, a thick sheet having a strong stiffness can be securely buckled at a value less than a set upper limit of the feeding pressure. Even when a plurality of sheets is buckled and conveyed over the separation slope, a thin sheet having a weak stiffness can be loosened in the separation nip portion n between the separation member separately provided and the opposite member disposed to face and contact the separation member.

Figure 7:
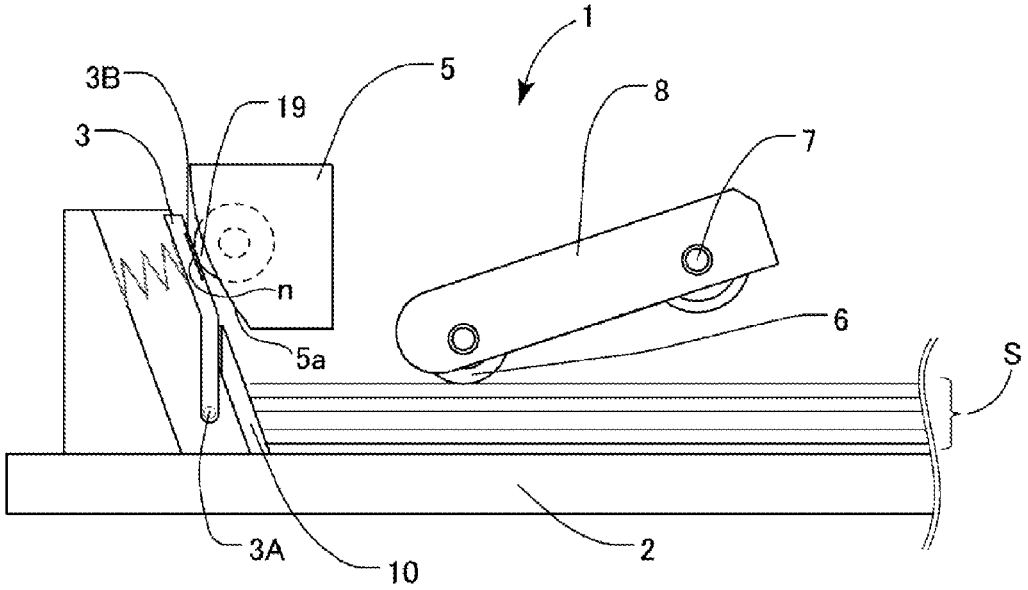
FIG. 7 is a cross-sectional view illustrating a first modification of the first embodiment.

Also, in the present embodiment, the opposite member 5 nipping the sheet with the sheet separation member 3 is provided as a fixed member, but is not limited thereto. That is, for example, as in a first modification illustrated in FIG. 7, a rotating member 19, such as a roller or a sphere, which rotates while following the passing of the sheet in the separation nip portion n, can be configured to be attached to a position of the opposite member 5 opposite to the friction member 3B. The configuration that provides the rotating member 19 in the opposite member 5 can be implemented in the same manner in the first embodiment described above, or second and third embodiments and second and third modifications described below.

Second Embodiment

Figure 9:
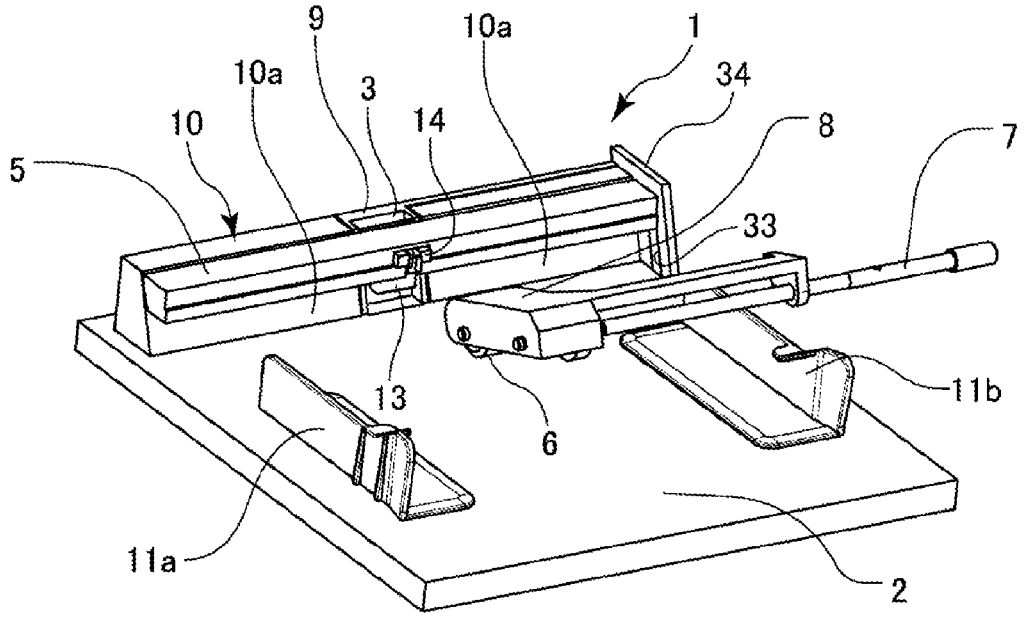
FIG. 9 is a perspective view illustrating a sheet feeding apparatus according to a second embodiment of the present invention.

Next, a sheet feeding apparatus 1 according to a second embodiment of the present invention will be described below with reference to FIGS. 9 to 10C. FIG. 9 is a perspective view of the sheet feeding apparatus 1 according to the present embodiment, and FIGS. 10A to 10C are cross-sectional views describing the detailed configuration of the present embodiment. Also, in the present embodiment, only parts different from the first embodiment will be described. The same reference numerals are assigned to the same components, and a description thereof will be omitted.

The present embodiment differs from the first embodiment in that the present embodiment further includes a separation member holder 9 which rotatably (pivotally) holds the sheet separation member 3. Also, the separation member holder 9 and the opposite member 5 are integrally movable in parallel to the separation slope 10*a* of the fixed slope portion 10, and the position of the separation nip portion n between the sheet separation member 3 and the opposite member 5 is movable.

In conjunction with the opposite member 5, the separation member holder 9 is provided to be movable in a vertical direction of the drawing, along a slide surface A continuously formed in the fixed slope portion 10 and the sheet tray 2, by a driving of a slide motor 30. In support portions 34 provided at both ends of the fixed slope portion 10 (only the right support portion is illustrated in FIG. 9), slide grooves 33 are formed in parallel to the slide surface A. The opposite member 5 is supported to be vertically movable along the slide grooves 33 in conjunction with the separation member holder 9.

Next, the slide operation of the separation nip portion n will be described below with reference to FIGS. 10A to 10C which are cross-sectional views of the sheet feeding apparatus 1 of the present embodiment. FIG. 10A schematically illustrates a state in which the sheet bundle S is set in the sheet tray 2.

Above a sheet holding surface 2*a* of the sheet tray 2, a sheet surface detection lever 13 which detects a sheet surface position is vertically pivotally supported to the opposite member 5, with a rotation center 13*a* as a supporting point.

In the opposite member 5 which is integrally vertically movable with the separation member holder 9, a detection lever sensor 14 is disposed at a position where a rotation angle of the sheet surface detection lever 13 can be detected at the top of the sheet surface detection lever 13. The detection lever sensor 14 is provided with, for example, a transmission-type optical sensor such as a photo interrupter. The detection lever sensor 14 includes a light emitting portion 14*a* and a light receiving portion (not illustrated), and outputs a detection signal according to open and closed states of an optical path between the light emitting portion 14*a* and the light receiving portion. In FIG. 10A, the optical path is in an open state.

Figure 10A:
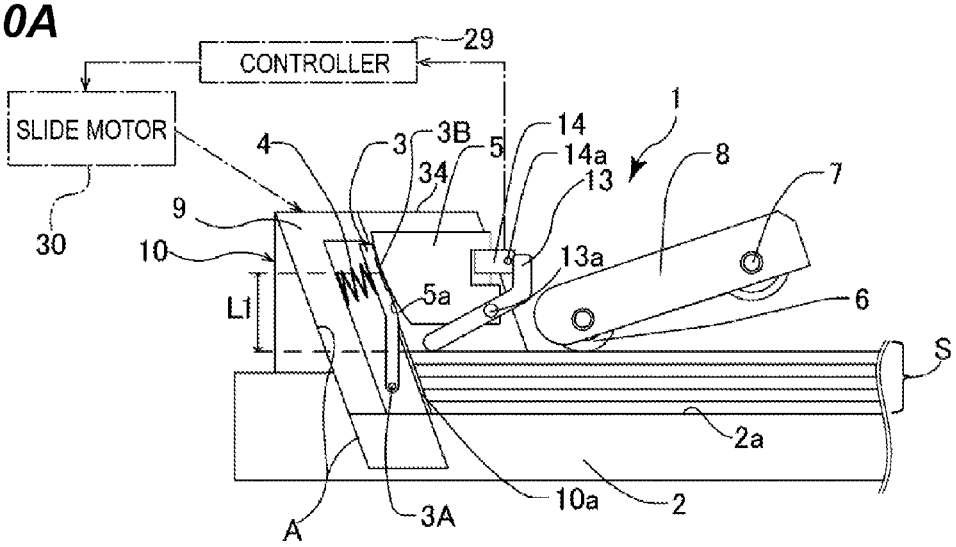
FIGS. 10A to 10C are cross-sectional views illustrating the sheet feeding apparatus according to the second embodiment.

L1 is a vertical distance from the front edge of the top sheet Sa in the feeding direction in the state of FIG. 10A to the central portion of the separation nip portion n between the sheet separation member 3 and the opposite member 5. A feeding operation by the feeding roller 6 is started. As the sheets S are conveyed, an amount of the sheets S stacked on the sheet tray 2 is reduced, and the sheet surface detection lever 13 is gradually rotated counterclockwise around the rotation center 13*a* as the supporting point.

Figure 10B:
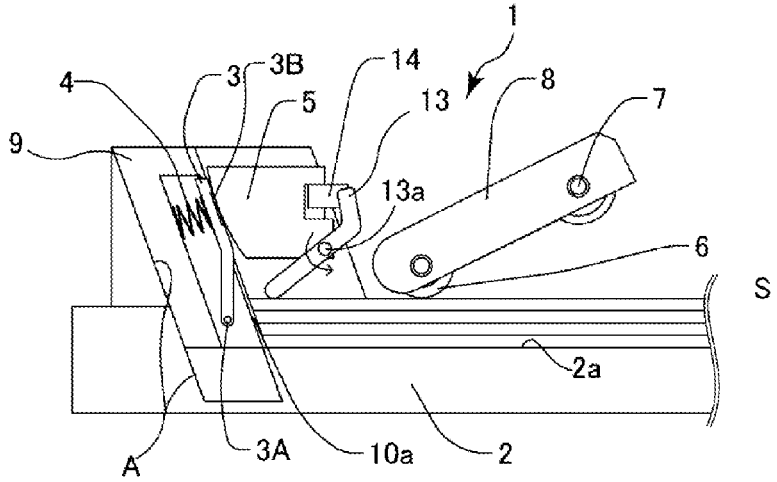

When the amount of the stacked sheets is smaller than a certain predetermined amount, as illustrated in FIG. 10B, the light emitting portion 14*a* of the detection lever sensor 14 is blocked by the sheet surface detection lever 13. Therefore, the detection signal for driving the slide motor 30 is output from the detection lever sensor 14 to a controller 29 as a control unit provided in the apparatus body 100*a*. The controller 29 controls a driving of the slide motor 30 based on the detection signal, and moves the separation member holder 9 and the opposite member 5 downward along the slide surface A, such that the separation member holder 9 and the opposite member 5 integrally move along the separation slope 10*a*.

When the opposite member 5 moves downward, the sheet surface detection lever 13, the bottom portion of which abuts against the top surface of the sheet bundle S, is rotated clockwise. Thus, as illustrated in FIG. 10C, the optical path of the detection lever sensor 14 is opened. Therefore, the controller 29 stops driving the slide motor 30 based on the signal of the detection lever sensor 14, and stops lowering the separation member holder 9 and the opposite member 5.

Figure 10C:
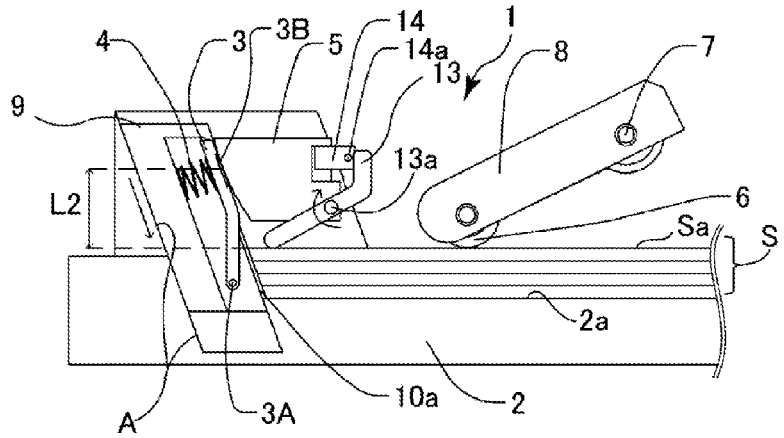

A vertical distance L2 from the front edge of the top sheet Sa in the feeding direction in the state of FIG. 10C to the central portion of the separation nip portion n is substantially equal to the distance L1 before the driving of the slide motor 30 (FIG. 10A). Also, since the principle of separately conveying the sheets is equal to the first embodiment, a description thereof will be omitted herein.

In the present embodiment described above, one of the second separating unit and the sheet stacking unit is movably supported to the other. That is, the sheet separation member 3 and the opposite member 5 as the second separating unit are movably supported to the sheet tray 2 as the sheet stacking unit. The controller 29 moves (lowers) the second separating unit toward the sheet tray 2 based on a reduced amount of sheets S on the sheet tray 2 (on the sheet stacking unit) with respect to the second separating units (3, 5). Therefore, the distances L1 and L2 between the top sheet Sa on the sheet tray and the separation nip portion n are substantially constantly maintained.

Thus, a variation in the position of the top sheet Sa of the sheet bundle according to the feeding can be detected by the sheet surface detection lever 13 and the detection lever sensor 14, and the vertical position of the separation nip portion n can be moved in parallel along the separation slope 10*a* according to the variation. Therefore, the vertical distance from the front edge of the top sheet Sa in the feeding direction to the separation nip portion n can be considered to be substantially constant without regard to the amount of the stacked sheets.

In the present embodiment, the above configuration can always stabilize the posture of the front edge of the sheet at the time of the entry into the separation nip portion n, and can separate and feed the sheet more stably from a fully stacked state to a slightly stacked state.

Third Embodiment

Figure 13A:
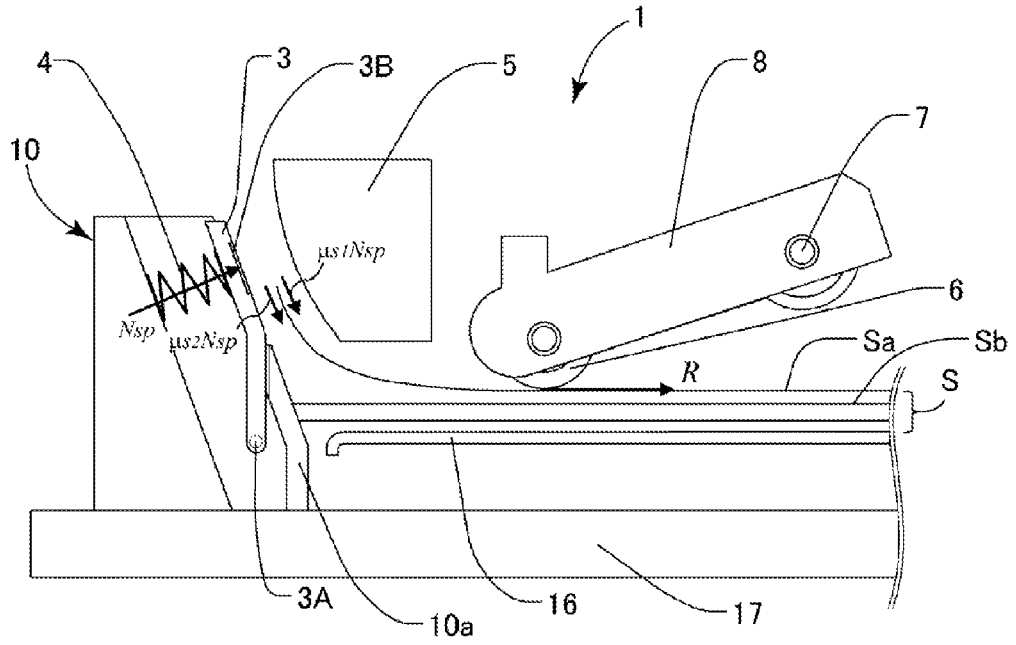
FIGS. 13A and 13B are diagrams illustrating a force acting on one sheet in the contact portion between the sheet separation member 3 and the opposite member 5 according to the third embodiment.
Figure 13B:
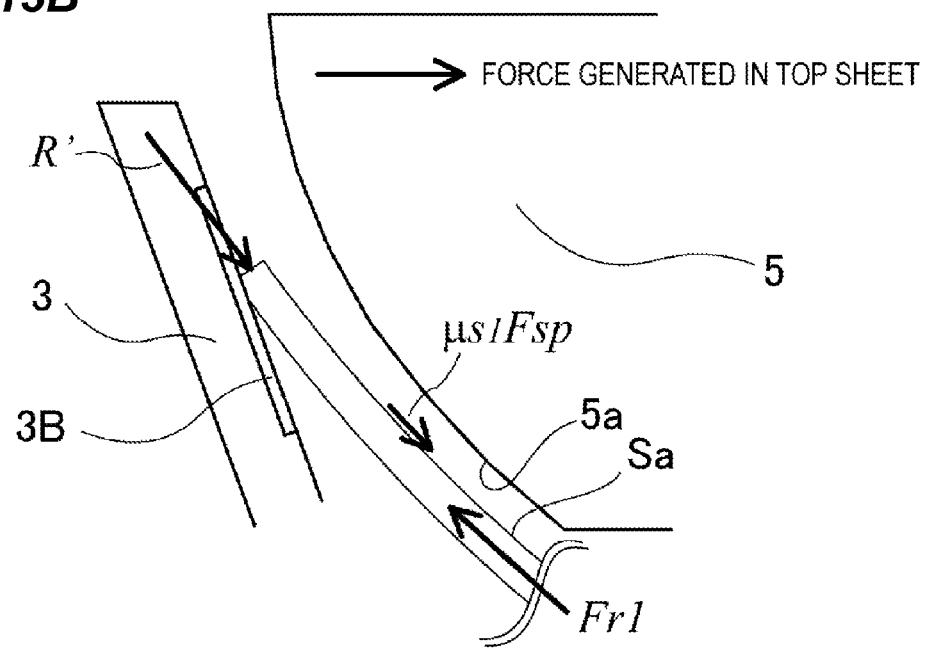

Next, a sheet feeding apparatus 1 according to a third embodiment of the present invention will be described below with reference to FIGS. 11A and 13B. Also, in the present embodiment, only parts different from the first embodiment will be described. The same reference numerals are assigned to the same components, and a description thereof will be omitted.

Figure 11A:
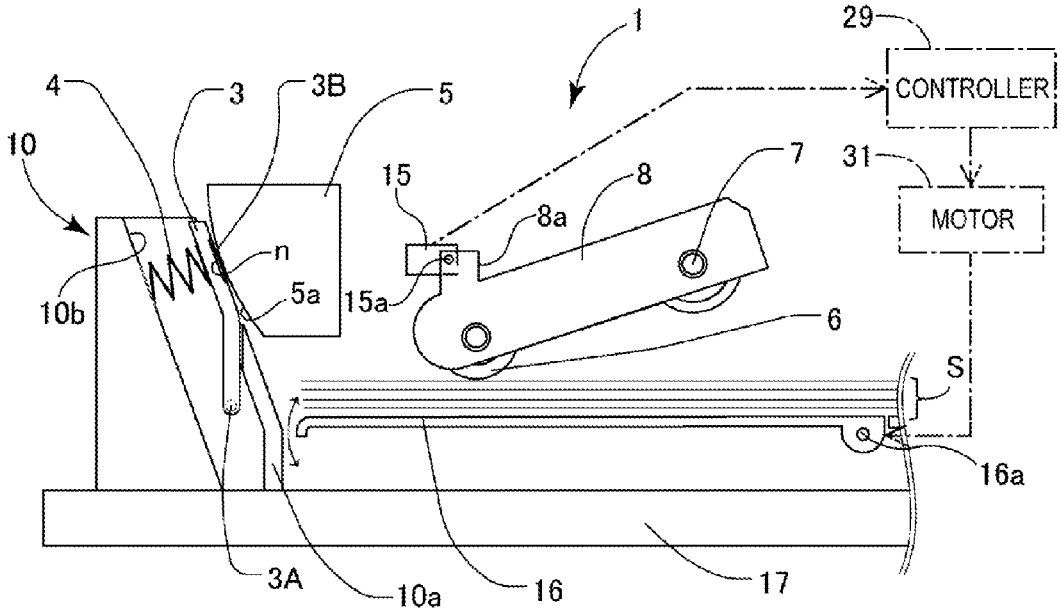
FIG. 11A is a cross-sectional view of a sheet feeding apparatus according to a third embodiment of the present invention.

FIG. 11A is a cross-sectional view of the sheet feeding apparatus 1 according to the present embodiment. The present embodiment differs from the first embodiment in that a sheet support portion 16 provided in a predetermined space above a bottom plate 17 is configured to be rotatable around a rotation center 16*a* as a supporting point, the rotation center 16*a* being provided in the upstream in the sheet feeding direction D (see FIG. 8).

The sheet support portion 16 as a sheet stacking unit is held to be rotated by a driving of a motor 31 based on control of a controller 29 provided in an apparatus body 100*a*. When a rotation angle of a pivot frame 8 exceeds a certain predetermined range, it is detected by a pivot frame sensor 15 being a transmission-type optical sensor. The controller 29 as a control unit controls a driving of the motor 31 based on a detection signal output the pivot frame sensor 15. Also, as in the first embodiment, the pivot frame 8 is rotatably supported by a pivot shaft 7.

The pivot frame sensor 15 can be provided with, for example, a transmission-type optical sensor such as a photo interrupter. In this configuration, the pivot frame sensor 15 includes a light emitting portion 15*a* and a light receiving portion (not illustrated), and outputs a detection signal according to opening or blocking of an optical path between the light emitting portion 15*a* and the light receiving portion by a shielding portion 8*a* protruding from a front edge upper portion of the pivot frame 8. In FIG. 11A, the optical path is in a blocked state.

The controller 29 controls the motor 31 based on the detection signal of the pivot frame sensor 15, such that the sheet support portion 16 is rotated around the rotation center 16*a* as the supporting point. Therefore, a top sheet Sa is always located within a constant height direction range without regard to a stacked amount of a sheet bundle S.

Since the top sheet Sa can be disposed at the same position by the sheet support portion 16, without regard to the stacked amount, the distance from a buckling point of the sheet to the separation nip portion n can be always constantly maintained.

Therefore, it is possible to stabilize the behavior of the front edge of the sheet at the time of the entry into the nip portion.

Also, by maintaining the constant position of the top sheet Sa, a variation in an abutting angle of the pivot frame 8 against the top sheet Sa at the time of starting the feeding operation by a variation in the amount of the stacked sheets can be kept within a small range. Therefore, it is possible to minimize a variation in the feeding pressure N due to the amount of the stacked sheets and to more stably separate and feed the sheets from a state in which sheets are slightly stacked to a state in which sheets are fully stacked.

Subsequently, the principle of separating and conveying the sheets by the separation slope 10*a* according to the present embodiment will be described below with reference to FIG. 11B.

Figure 11B:
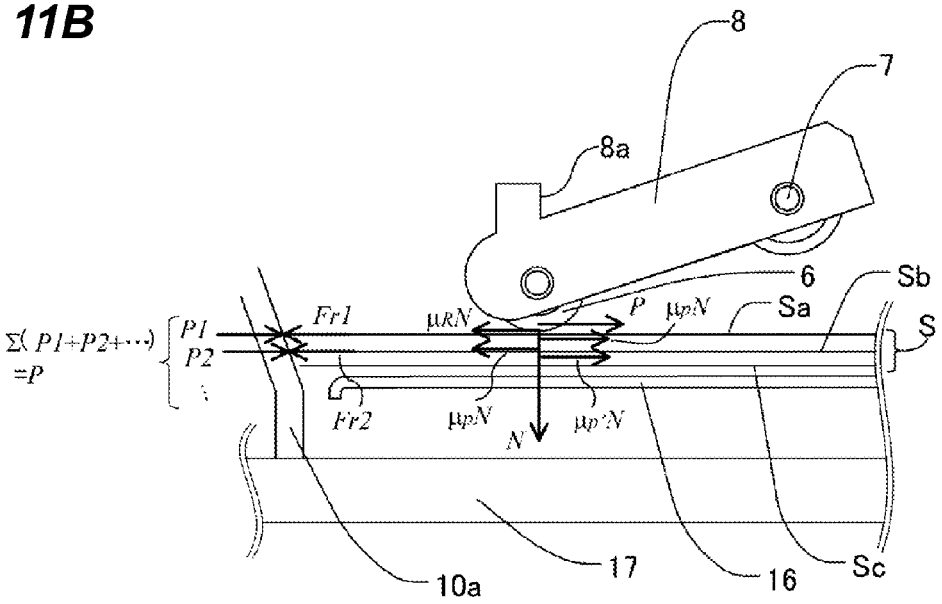
FIG. 11B is a diagram illustrating a force generated in a feeding roller 6 and a separation slope 10*a* at the time of feeding.

As illustrated in FIG. 11B, the feeding roller 6 generates the feeding pressure N to the sheet by transferring rotation in a state of abutting against the top sheet Sa. Hereinafter, when a friction coefficient between the feeding roller 6 and the sheet is μR, the top sheet Sa obtains a conveyance force Fr=μR·N generated by the feeding roller 6.

On the other hand, when a friction coefficient between the top sheet Sa and a second sheet Sb is μp, the top sheet Sa receives a resistance force Rr1=μp·N by the second sheet Sb, and thus, a conveyance force Fr1 generated in the top sheet Sa is expressed as Equation (6) below.

$$Fr1=Fr-Rr1=(\mu R-\mu p)N \quad (6)$$

When the top sheet Sa is conveyed by the conveyance force Fr1 generated in the top sheet Sa, the front edge in the sheet feeding direction abuts against the separation slope 10*a*, and a conveyance resistance P1 is generated in a direction substantially horizontal to the top sheet Sa. Due to the conveyance resistance P1, a conveyance resistance P is also generated in a direction substantially horizontal to the feeding roller 6.

When the feeding pressure N is increased by the conveyance resistance P generated in the feeding roller 6, the conveyance force Fr1 generated in the top sheet Sa is increased, and the conveyance resistance P1 generated in the top sheet Sa is also increased against the conveyance force Fr1. Finally, when the conveyance force Fr1 generated in the top sheet Sa reaches a sheet buckling force Pz, the sheet is fed in a manner such that the front edge of the sheet buckles and gets on the separation slope 10*a*.

When a friction coefficient between the second sheet Sb and a third sheet Sc is μp', a conveyance force Fr2 generated in the second sheet Sb is as follows. That is, as illustrated in FIG. 11B, since the conveyance force Fr2 is a difference between a conveyance force FSa=μp·N the second sheet Sb receives from the top sheet Sa and a resistance force Rr2=μp'·N by the third sheet Sc, the conveyance force Fr2 is expressed as Equation (7) below.

$$Fr2=FSa-Rr2=(\mu p-\mu p')N \quad (7)$$

Figure 12A:
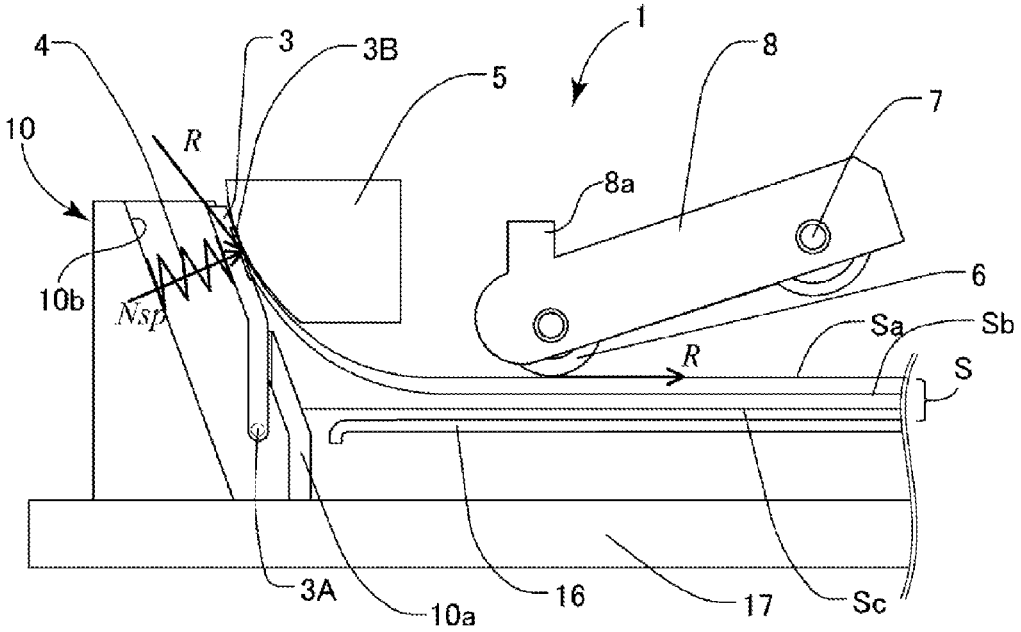
FIGS. 12A and 12B are diagrams illustrating a force acting on two sheets in a contact portion between a sheet separation member 3 and an opposite member 5 according to the third embodiment.
Figure 12B:
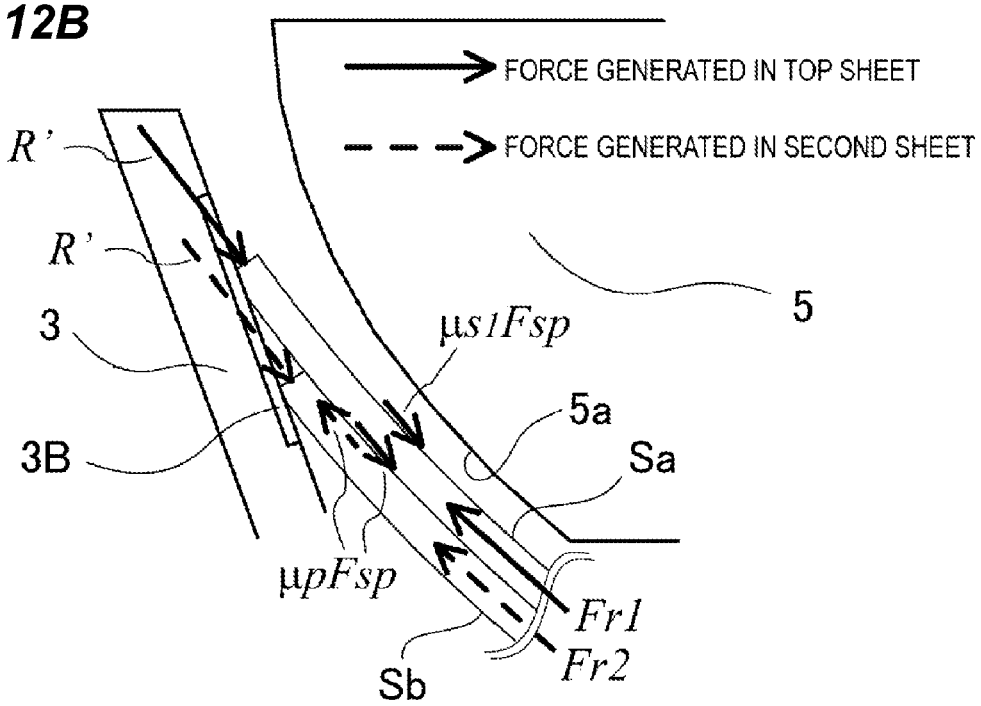

Next, the principle of separating a plurality of sheets in the separation nip portion n between the sheet separation member 3 and the opposite member 5 will be described below with reference to FIGS. 12A and 12B. FIG. 12B is an enlarged view of the separation nip portion n between the sheet separation member 3 and the opposite member 5 in the cross-sectional view illustrated in FIG. 12A. For easy illustration of the force acting on each of the sheets, the sheet separation member 3 and the opposite member 5 are drawn away.

For example, when two sheets are conveyed across the separation slope 10*a* in an overlapped state, the two sheets enter the separation nip portion n, and a resistance force R acting on the sheet is generated. The resistance force R acting on the sheet is the sum of a resistance force R1 acting on the top sheet Sa and a resistance force R2 acting on the second sheet Sb (R=R1+R2). Also, since the feeding roller 6 also receives a resistance having the same magnitude as the resistance force R acting on the sheet, the conveyance resistance P generated in the feeding roller 6 has the same value as the resistance force R acting on the sheet (P=R).

In each of the sheets, since the front edge (downstream end) in the sheet feeding direction abuts against the friction member 3B attached to the sheet separation member 3, a resistance force R' received from the friction member 3B is generated. The front edge in the sheet feeding direction is conveyed while receiving the resistance force R' received from the friction member 3B, and the top sheet Sa is conveyed separately from the second sheet Sb.

It is assumed that a friction coefficient between the opposite member 5 and the sheet is μs1, and an acting force of the compression spring 4 is Fsp. In this case, when two sheets enter the separation nip portion n, the resistance force R1 acting on the top sheet Sa and the resistance force R2 acting on the second sheet Sb can be expressed as Equations (8) and (9) below.

$$R1=R'+(\mu s1+\mu p)Fsp \quad (8)$$

$$R2=R'-\mu p\cdot Fsp \quad (9)$$

In order to separately convey the two sheets, the conveyance force Fr1 generated in the top sheet Sa needs to exceed the value of the resistance force R1 acting on the top sheet Sa, and the conveyance force Fr2 generated in the second sheet Sb needs to be lower than the value of the resistance force R2 acting on the second sheet Sb. The above condition is expressed as Inequality below.

$$\text{(Non-feed prevention condition)}Fr1=(\mu R-\mu p)N>R'+(\mu s1+\mu p)Fsp$$

$$\text{(Double-feed prevention condition)}Fr2=(\mu p-\mu p')N<R'-\mu p\cdot Fsp$$

Subsequently, a case where one sheet enters the separation nip portion n will be described with reference to FIGS. 13A and 13B. The resistance force R1 acting on the top sheet Sa is expressed as Equation (10) below.

$$R1=R'+\mu s1\cdot Fsp \quad (10)$$

Herein, since the resistance force R acting on the sheet is only the resistance force R1 acting on the top sheet Sa, the resistance force R have the same value as the resistance force R1 (R=R1). In order to convey the sheet without jamming in the separation nip portion n, the conveyance force Fr1 generated in the top sheet Sa needs to exceed the value of the resistance force R acting on the sheet. The above condition is expressed as Inequality below.

$$\text{(Non-feed prevention condition)}Fr1=(\mu R-\mu p)N>R'-\mu s1\cdot Fsp$$

Since the above-described separating principle of the present embodiment is similar to that of the first embodiment, it can be seen that the separation conveyance is theoretically possible.

In the present embodiment described above, a sheet support portion 16 as a sheet stacking unit is movably supported to the sheet separation member 3 and the opposite member 5 as a second separating unit. The feeding roller 6 as a feeding unit is movably supported by following the movement of the sheet support portion 16 in a state of abutting against the sheet S on the sheet support portion 16. The controller 29 lifts the sheet support portion 16 together with the feeding roller 6, based on a moving amount of the feeding roller 6 lowered by following the reduction of the sheets S on the sheet support portion. Therefore, the distance between the top sheet Sa on the sheet support portion 16 and the separation nip portion n is substantially constantly held.

In the present embodiment, as compared with the first embodiment, it is possible to constantly maintain a distance between the buckling point of the sheet and the separation nip portion n on the separation slope 10*a*, without regard to the stacked amount of the sheet bundle, and it is possible to stabilize the behavior of the front edge of the sheet at the time of the entry into the separation nip portion n. Therefore, a better separation conveyance can be obtained. Also, since it is possible to minimize a variation in the feeding pressure N due to the amount of the stacked sheets, the sheet can be more stably fed.

Figure 14A:
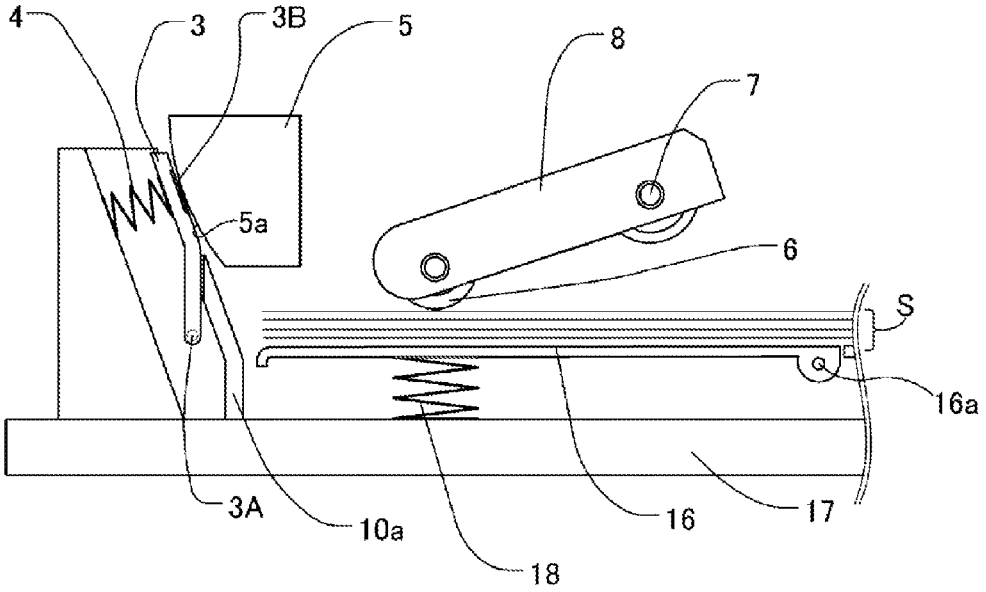
FIG. 14A is a cross-sectional view of a second modification according to the third embodiment.

Also, in the third embodiment, the motor 31 is used as a unit which pivotally rotates the sheet support portion 16, but the unit is not limited thereto. For example, as illustrated in a second modification of FIG. 14A, it may be configured such that the compression spring 18 is provided on a bottom portion of the sheet support portion 16 in a compressed state, and the sheet support portion 16 is biased toward the feeding roller 6. In this case, the same effect as described above can also be obtained.

Figure 14B:
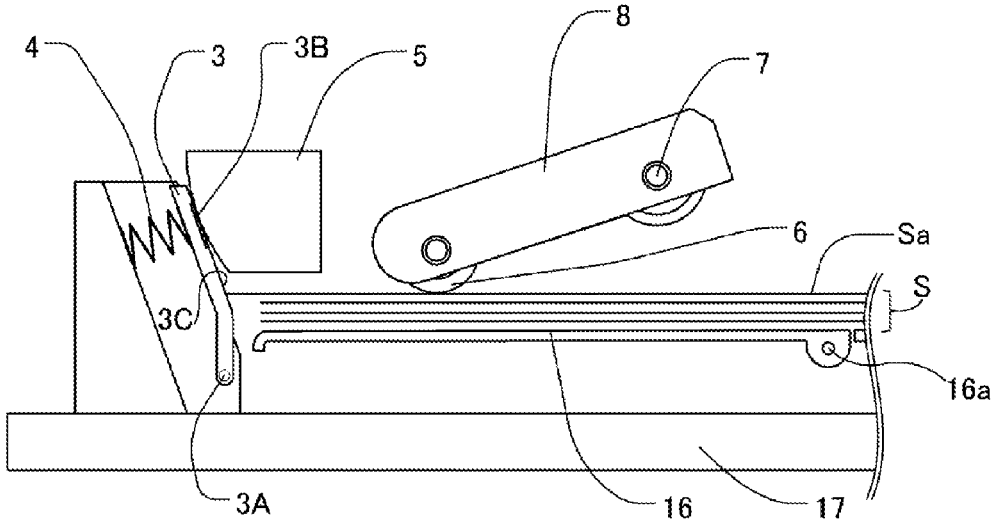
FIG. 14B is a cross-sectional view of a third modification according to the third embodiment.

Also, in the present embodiment, the sheet is buckled and separated in a manner such that the front edge of the top sheet Sa in the sheet feeding direction abuts against the separation slope 10*a*. However, for example, as illustrated in a third modification of FIG. 14B, it may be configured such that the sheet is buckled by extending a slope surface 3C of the sheet separation member 3 downward in the drawing, and abutting the front edge of the sheet against the extended portion. In this case, the same effect as described above can also be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-003900, filed Jan. 11, 2013, which is hereby incorporated by reference herein in its entirety.

What is claimed is:

1. A sheet feeding apparatus comprising:

a sheet stacking unit on which sheets are stacked;

a feeding unit which contacts a top sheet of the sheets stacked on the sheet stacking unit, and feeds the sheet in a sheet feeding direction;

a conveying unit which receives the sheet fed by the feeding unit and conveys the sheet in a sheet conveying direction intersecting with the sheet feeding direction;

a first separating unit which is disposed between the feeding unit and the conveying unit, the first separating unit including a separation slope, the separation slope being inclined upwards in the downstream direction and the separation slope extending in a sheet width direction perpendicular to the sheet feeding direction so as to abut against a front edge of the sheet fed by the feeding unit and separate the sheet one by one; and a second separating unit which is disposed between the first separating unit and the conveying unit and is positioned at an extension of the separation slope in the sheet feeding direction, wherein the second separating unit includes a sheet separation member which is movable to a protruding position and a retracted position, wherein the sheet separation member is disposed in a notch portion formed in a center of the separation slope in the sheet width direction;

an opposite member which includes a surface in a stationary state disposed to face the sheet separation member; and a biasing unit which biases the sheet separation member from the retracted position to the protruding position so as to abut the sheet separation member against the opposite member at the protruding position to form a separation nip portion which separates the sheet having passed through the separation slope one by one.

2. The sheet feeding apparatus according to claim 1, wherein the surface of the opposite member is a curved surface which guides a sheet moving past the separation nip portion by sliding contact.

3. The sheet feeding apparatus according to claim 1, wherein the opposite member includes a rotating member which rotates with respect to a sheet moving past the separation nip portion.

4. The sheet feeding apparatus according to claim 1, wherein the sheet stacking unit is fixed, the feeding unit includes:

a feeding roller which feeds a sheet by rotating while abutting against a sheet stacked on the sheet stacking unit; and a pivot frame which supports the feeding roller and is pivotally provided, and when an amount of stacked sheets is reduced, the feeding roller is lowered to maintain abutment against the sheet.

5. The sheet feeding apparatus according to claim 1, further comprising a control unit, wherein one of the second separating unit and the sheet stacking unit is movably supported to the other, and the control unit is configured to perform control such that a distance between a top sheet on the sheet stacking unit and the separation nip portion is substantially constantly maintained while following a reduction of the sheets by moving the one of the second separating unit and the sheet stacking unit toward the other.

6. The sheet feeding apparatus according to claim 5, wherein the second separating unit is movably supported to the sheet stacking unit, and the control unit is configured to substantially constantly maintain the distance between the top sheet on the sheet stacking unit and the separation nip portion by moving the second separating unit toward the sheet stacking unit based on a reduced amount of sheets on the sheet stacking unit with respect to the second separating unit.

7. The sheet feeding apparatus according to claim 5, wherein the sheet stacking unit is movably supported to the second separating unit, the feeding unit is movably supported while following a movement of the sheet stacking unit in a state of abutting against a sheet on the sheet stacking unit, and the control unit is configured to substantially constantly maintain the distance between the top sheet on the sheet stacking unit and the separation nip portion by moving the sheet stacking unit toward the second separating unit together with the feeding unit, based on a moving amount of the feeding unit which moves while following a reduction of sheets on the sheet stacking unit.

8. A sheet feeding apparatus comprising:

a sheet stacking unit on which sheets are stacked;

a feeding unit which contacts a top sheet of the sheets stacked on the sheet stacking unit, and feeds the sheet in a sheet feeding direction;

a conveying unit which receives the sheet fed by the feeding unit and conveys the sheet in a sheet conveying direction intersecting with the sheet feeding direction;

a separation slope which is disposed between the feeding unit and the conveying unit, the separation slope being inclined upwards in the downstream direction, so as to abut against a front edge of the sheet fed by the feeding unit and separate the sheet one by one;

a separation member which is disposed on the separation slope in a center of a width direction perpendicular to the sheet feeding direction, and includes a friction member on that the sheet is slidably contacted;

an opposite member which includes a surface in a stationary state disposed to face the friction member; and a biasing unit which biases the separation member against the opposite member to form a separation nip portion which separates the sheet one by one.

9. The sheet feeding apparatus according to claim 8, wherein a notch portion is formed on the separation slope in the center of the width direction perpendicular to the sheet feeding direction, the friction member is disposed in the notch portion, and the friction member is biased in a direction protruding from the notch portion by the biasing unit.

10. The sheet feeding apparatus according to claim 8, wherein the sheet stacking unit is fixed, the feeding unit includes a feeding roller which feeds a sheet by rotating while abutting against a sheet stacked on the sheet stacking unit, and a pivot frame which supports the feeding roller and is pivotally provided, and when an amount of stacked sheets is reduced, the feeding roller is lowered to maintain abutment against the sheet.

11. An image forming apparatus comprising:

an image forming portion which forms an image on a sheet; and a sheet feeding apparatus which supplies the sheet to the image forming portion, wherein the sheet feeding apparatus including:

a sheet stacking unit on which sheets are stacked;

a feeding unit which contacts a top sheet of the sheets stacked on the sheet stacking unit, and feeds the sheet in a sheet feeding direction;

a conveying unit which receives the sheet fed by the feeding unit and conveys the sheet in a sheet conveying direction intersecting with the sheet feeding direction;

a first separating unit which is disposed between the feeding unit and the conveying unit, the first separating unit including a separation slope, the separation slope being inclined upwards in the downstream direction and the separation slope extending in a sheet width direction perpendicular to the sheet feeding direction so as to abut against a front edge of the sheet fed by the feeding unit and separate the sheet one by one; and a second separating unit which is disposed between the first separating unit and the conveying unit and is positioned at an extension of the separation slope in the sheet feeding direction, wherein the second separating unit includes a sheet separation member which is movable to a protruding position and a retracted position, wherein the sheet separation member is disposed in a notch portion formed in a center of the separation slope in the sheet width direction;

an opposite member which includes a surface in a stationary state disposed to face the sheet separation member; and a biasing unit which biases the sheet separation member from the retracted position to the protruding position so as to abut the sheet separation member against the opposite member at the protruding position to form a separation nip portion which separates the sheet having passed through the separation slope one by one.

12. The image forming apparatus according to claim 11, wherein the opposite member has a curved surface which guides a sheet moving past the separation nip portion by sliding contact.

13. The image forming apparatus according to claim 11, wherein the opposite member includes a rotating member which rotates with respect to a sheet moving past the separation nip portion.

14. The image forming apparatus according to claim 11, wherein the sheet stacking unit is fixed, the feeding unit includes:

a feeding roller which feeds a sheet by rotating while abutting against a sheet stacked on the sheet stacking unit; and a pivot frame which supports the feeding roller and is pivotally provided, and when an amount of stacked sheets is reduced, the feeding roller is lowered to maintain abutment against the sheet.

15. The image forming apparatus according to claim 11, further comprising a control unit, wherein one of the second separating unit and the sheet stacking unit is movably supported to the other, and the control unit is configured to perform control such that a distance between a top sheet on the sheet stacking unit and the separation nip portion is substantially constantly maintained while following a reduction of the sheets by moving the one of the second separating unit and the sheet stacking unit toward the other.

16. The image forming apparatus according to claim 15, wherein the second separating unit is movably supported to the sheet stacking unit, and the control unit is configured to substantially constantly maintain the distance between the top sheet on the sheet stacking unit and the separation nip portion by moving the second separating unit toward the sheet stacking unit based on a reduced amount of sheets on the sheet stacking unit with respect to the second separating unit.

17. The image forming apparatus according to claim 15, wherein the sheet stacking unit is movably supported to the second separating unit, the feeding unit is movably supported while following a movement of the sheet stacking unit in a state of abutting against a sheet on the sheet stacking unit, and the control unit is configured to substantially constantly maintain the distance between the top sheet on the sheet stacking unit and the separation nip portion by moving the sheet stacking unit toward the second separating unit together with the feeding unit, based on a moving amount of the feeding unit which moves while following a reduction of sheets on the sheet stacking unit.

18. An image forming apparatus comprising:

an image forming portion which forms an image on a sheet; and a sheet feeding apparatus which supplies the sheet to the image forming portion, the sheet feeding apparatus including:

a sheet stacking unit on which sheets are stacked;

a feeding unit which contacts a top sheet of the sheets stacked on the sheet stacking unit, and feeds the sheet in a sheet feeding direction;

a conveying unit which receives the sheet fed by the feeding unit and conveys the sheet in a sheet conveying direction intersecting with the sheet feeding direction;

a separation slope which is disposed between the feeding unit and the conveying unit, the separation slope being inclined upwards in the downstream direction, so as to abut against a front edge of the sheet fed by the feeding unit and separate the sheet one by one;

a separation member which is disposed on the separation slope in a center of a width direction perpendicular to the sheet feeding direction, and includes a friction member on which the sheet is slidably contacted;

an opposite member which includes a surface in a stationary state disposed to face the friction member; and a biasing unit which biases the friction member against the opposite member to form a separation nip portion which separates the sheet one by one.

19. The image forming apparatus according to claim 18, wherein a notch portion is formed on the separation slope in the center of the width direction perpendicular to the sheet feeding direction, the friction member is disposed in the notch portion, and the friction member is biased in a direction protruding from the notch portion by the biasing unit.

20. The image forming apparatus according to claim 18, wherein the sheet stacking unit is fixed, the feeding unit includes a feeding roller which feeds a sheet by rotating while abutting against a sheet stacked on the sheet stacking unit, and a pivot frame which supports the feeding roller and is pivotally provided, and when an amount of stacked sheets is reduced, the feeding roller is lowered to maintain abutment against the sheet.

* * * * *